US005412155A

United States Patent [19]

Kosugi

[11] Patent Number: 5,412,155

[45] Date of Patent: May 2, 1995

[54] ENVELOPE GENERATOR FOR ELECTRONIC MUSICAL INSTRUMENT

[75] Inventor: Taichi Kosugi, Shizuoka, Japan

[73] Assignee: Kabushiki Kaisha Kawai Gakki Seisakusho, Hamatsu, Japan

[21] Appl. No.: 143,349

[22] Filed: Oct. 26, 1993

[30] Foreign Application Priority Data

Nov. 2, 1992 [JP] Japan ..... 4-315580

[51] Int. Cl.[6] ..... G10H 1/057

[52] U.S. Cl. ..... 84/627; 84/663

[58] Field of Search ..... 84/627, 663

[56] References Cited

U.S. PATENT DOCUMENTS 4,144,789 3/1979 Deutsch ..... 84/627 X
4,421,003 12/1983 Kondo ..... 84/627
4,953,437 9/1990 Starkey ..... 84/627 X

*Primary Examiner*—Stanley J. Witkowski
*Attorney, Agent, or Firm*—Westman, Champlin & Kelly

[57] ABSTRACT

An envelope generator for an electronic musical instrument, in which a current value of the envelope approaching asymptotically to a target level, using a subtracter means for subtracting from data representing the target level in a floating point representation, data representing the difference between the target level and the current value in a floating point representation with deeming these data as fixed point data each having a decimal point between an exponent part and a fractional part, and a comparator for comparing the output of the subtracter means with a predetermined constant, and for judging that an envelope phase transfer condition is met if the output of the subtracter is greater than the constant. The envelope generator can achieve a phase transfer control function substantially similar to prior art envelope generators by a small amount of hardware.

8 Claims, 5 Drawing Sheets

ENVELOPE GENERATOR FOR ELECTRONIC MUSICAL INSTRUMENT

BACKGROUND OF THE INVENTION

1. Field of the Invention

The present invention is related to an envelope generator for an electronic musical instrument, and particularly to an envelope generator for an electronic musical instrument in which a transfer condition of an envelope phase can be judged with simple hardware.

2. Description of the Prior Art

Conventionally, in the electronic musical instrument, a system has been used in which a musical tone wave is read out from a wave memory and the wave signal is multiplied by an envelope to generate a musical tone wave signal. FIG. 1 is a functional block diagram shows the configuration of such electronic musical instrument. Keyboard 31 comprises, for instance, a plurality of keys each having a pair of switches.

Key assigner 32 consists of, for instance, a microcomputer or the like, and performs a so-called key assign processing and tone generating processing as follows. Key assigner 32 scans each switch of the keyboard 31 to check ON/OFF thereof for detecting a depressed key, and measures the key depression speed on the basis of the time-lag of the moments when the pair of switches corresponding the depressed key turn on to obtain an information on strength of tone generated by the depressed key. Then, it selects an idle channel of a plurality of tone generating channels, and instructs the selected channel to generate a tone of the pitch, tone strength and tone color corresponding to the depressed key.

Particularly, for key-on, key assigner 32 reads out from frequency data memory 33 a wave memory read address interval corresponding to the pitch corresponding to the depressed key, and sets it in accumulator 34. Also, according to the detected tone strength and predetermined tone color, key assigner 32 sets envelope generation control data (attack level, attack speed, etc.) in envelope generator 36.

Accumulator 34 accumulates the set wave memory read address intervals for each sampling period, and supplies the accumulated value to wave data generator (for example, ROM which stores wave data) 35 as an address to read out wave data therefrom. On the other hand, an envelope signal is generated from envelope generator 36 according to the set data, then the wave data and the envelope signal are multiplied together by multiplier 37 to form a musical tone wave signal. The musical tone wave signal is converted by D/A converter 38 to an analog tone signal which is amplified and converted by a sound system (e.g. amplifiers and speakers) to a musical tone. In FIG. 1, accumulator 34, wave data generator 35, envelope generator 36, multiplier 37 and D/A converter 38 can serve as a plurality of tone generating channels by time division multiprocessing.

In addition, upon detection of key-off, the key assigner 32 instructs envelope generator 36 to release or cease the tone generating.

FIG. 2 is a wave form diagram showing an example of the envelope wave generated in envelope generator 36. At key-on time (t0), an attack level L corresponding to the strength of key depression is set by key assigner and during an attack phase (t0–t1), a signal is generated which increases asymptotically from 0 to the attack level L at an attack speed that is set according to the tone color at the key-on time.

At time t1, upon detection of a current value E having reached to a value predetermined with relation to the attack level L, for instance, a value or level P corresponding to 90% of the attack level L, a decay phase is entered to generate a signal which approaches asymptotically to a decay level D at a decay speed that is set at the key-on time. The reason for employing such method for judging phase transfer is that timing for phase transfer (t1) is not varied even for a different attack level L if the attack speed is equal.

FIG. 3 is a block diagram showing an example of the conventional envelope generator 36. Current envelope value memory 1 stores a current value of envelope in fixed point data of 24 bits. Envelope phase memory 2 is a one-bit memory for storing a current phase of the envelope, and represents an attack phase if it contains "0", while it represents a decay phase if it contains "1".

Attack level memory 3 and decay level memory 4 respectively store the attack level L and decay level D which are set by the key assigner. Attack speed memory 5 and decay speed memory 6 store the asymptotic speeds in attack and decay phases, respectively, which are set by assigner 32 at the key-on time. All the data stored in these memories are in a floating point representation having an exponent part (power) of 4 bits (higher order four bits) and a fractional part (mantissa) of 4 bits (lower order four bits). Selectors 7 and 8 are controlled by the output of envelope phase memory 2 so that they output the contents of attack level memory 3 and attack speed memory 5 in the attack phase and select the contents of decay level memory 4 and decay speed memory 6 in the decay phase, respectively.

Floating point data to fixed point data conversion (F1Fx conversion) circuit 9 converts (4+4)-bit floating point data to 24-bit fixed point data. The F1Fx conversion circuit may be, for instance, a ROM which stores a conversion table, barrel shifter, or a combination of a counter and a shift register. Subtracter 10 subtracts the value E in the current envelope value memory from a target value converted to fixed point data, for instance, L. The difference (L−E) is reversely converted to floating point data by fixed point data to floating point data conversion (FxF1 conversion) circuit 11. The FxF1 conversion circuit can be comprised of, for instance, a combination of a barrel shifter and a priority encoder.

Multiplier 12 multiplies the difference value by the (4+4)-bit value in attack speed memory 5 or decay speed memory 6. This multiplication is performed in the floating point representation. That is, the fractional parts are multiplied together and the exponent parts are added. Accordingly, if it is assumed that the output of FxF1 conversion circuit 11 is in (4+8) bits, the output of multiplier 12 is in (5+12) bits at maximum.

The output of multiplier 12 is converted each to 24-bit fixed point data by F1Fx conversion circuit 13. Adder 14 adds the output of conversion circuit 13 and the value in current envelope value memory 1, and the resultant sum is written in current envelope value memory 1 to update the current value and the updated value is output. Thus, an output that approaches asymptotically to the target value is obtained.

Phase transfer control is now described. Multiplier 15 multiplies, for instance, in an attack phase, the output of selector 7 or the contents L of the attack level memory 3 by a predetermined constant K (e.g. 0.9). The constant K is in a floating point representation of (4+8) bits. The output of multiplier 15 is converted to 24-bit fixed point data by F1Fx conversion circuit 16.

Comparator 17 compares the output data of F1Fx conversion circuit 16 with the contents E of current envelope value memory 1, and generates an output signal "1" if the current envelope value E (at terminal A) is greater. Phase control circuit 18 directly writes the signal from comparator 17 in envelope phase memory 2 if the output of envelope phase memory 2 is "0", namely, for attack phase, and writes "1" if the output of envelope phase memory 2 is "1", namely, for decay phase.

With such circuit configuration, if the current envelope value E has reached 90% of the target value, the output of comparator 17 goes to "1" and hence the contents of envelope phase memory 2 is rewritten to "1", whereby a decay phase is entered. Such calculation is performed within a predetermined period, for instance, a sampling period, as many times as the number of tone generating channels which are time division multiplexed. In the conventional envelope generator as described above, there was a problem that a multiplier, F1Fx conversion circuit and comparator are required as the structural elements of the phase transfer control circuit, which increased hardware amount.

SUMMARY OF THE INVENTION

It is an object of the present invention to improve the prior art's problem as described above and provide an envelope generator for an electronic musical instrument, in which a substantially similar phase transfer control function can be accomplished by a smaller amount of hardware.

The present invention is an envelope generator for an electronic musical instrument which generates a current value that approaches asymptotically to a target value, characterized by including subtracter means for subtracting, from data representing the target value in a floating point representation, data representing the difference between the target value and the current value in a floating point representation, deeming said two data as ones in a fixed point representation having a decimal point between the exponent part and the fractional part, and judging means for comparing the output of said subtracter means with a predetermined constant, and judging that an envelope phase transfer condition has been met if the output of the subtracter means is greater. This allows the judgment on envelope phase transfer in an electronic musical instrument to be made with a smaller amount of hardware over the prior art.

DETAILED DESCRIPTION OF THE PREFERRED EMBODIMENT

Now, an embodiment of the present invention is described in detail with reference to the drawings.

The condition for phase transfer from attack to decay phase is first examined. The conventional and typical phase transfer condition is that the current level reaches, for instance, 90% of the attack level, and thus, if it is assumed that the attack level is L and the current envelope value is E, $$E/L>0.9.$$

If both sides of this expression are multiplied by −1 and added by one, the result is, $$1-(E/L)<0.1.$$

Therefore, $$(L-E)/L<0.1.$$

Then, the reciprocals of both sides are as follows.

$$L/(L-E)>10$$

The inequality is valid if logarithms to the base 2 are taken for both sides as follows.

$$\log_2 L-\log_2(L-E)>\log_2 10 \qquad \text{(Exp.1)}$$

In general, if the target approaching rate is assumed to be K ($0<K<1$), the transfer condition is $$E/L>K,$$

and expression 1 becomes as follows.

$$\log_2 L-\log_2(L-E)>\log_2[1/(1-K)] \qquad \text{(Exp.1B)}$$

Figure 1:
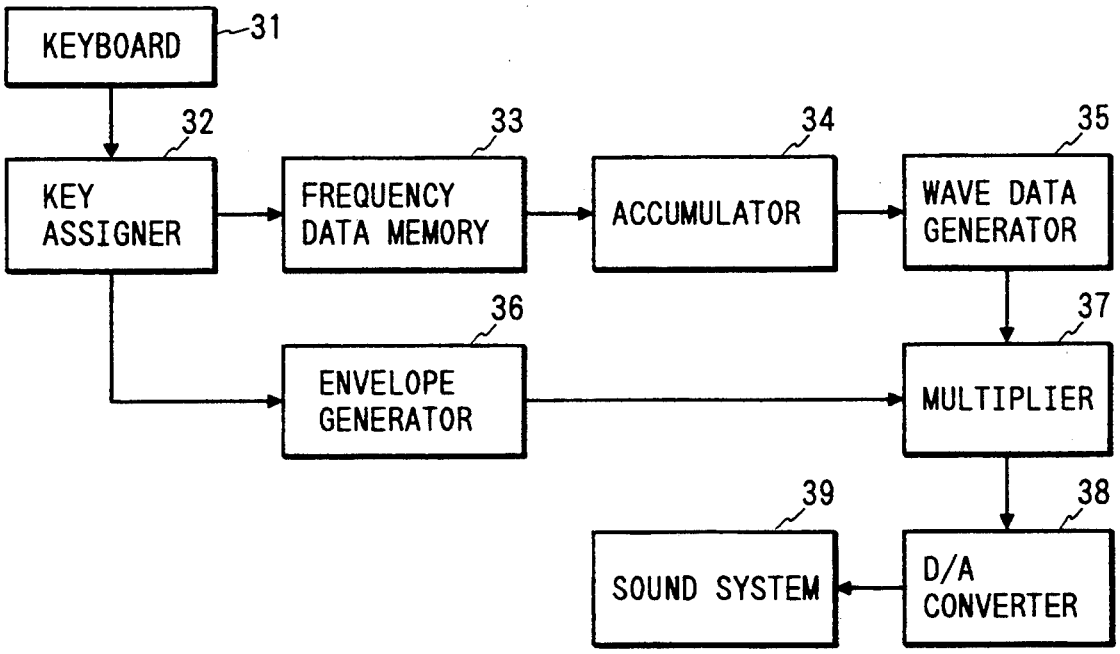
FIG. 1 is a functional block diagram showing the configuration of an electronic musical instrument.
Figure 2:
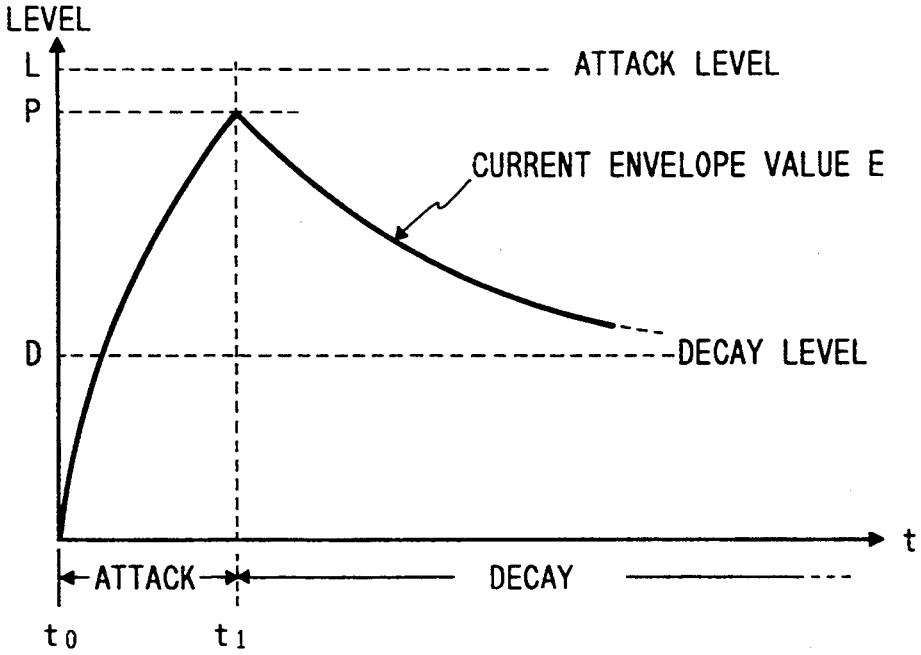
FIG. 2 is a wave diagram showing an example of an envelope wave.
Figure 3:
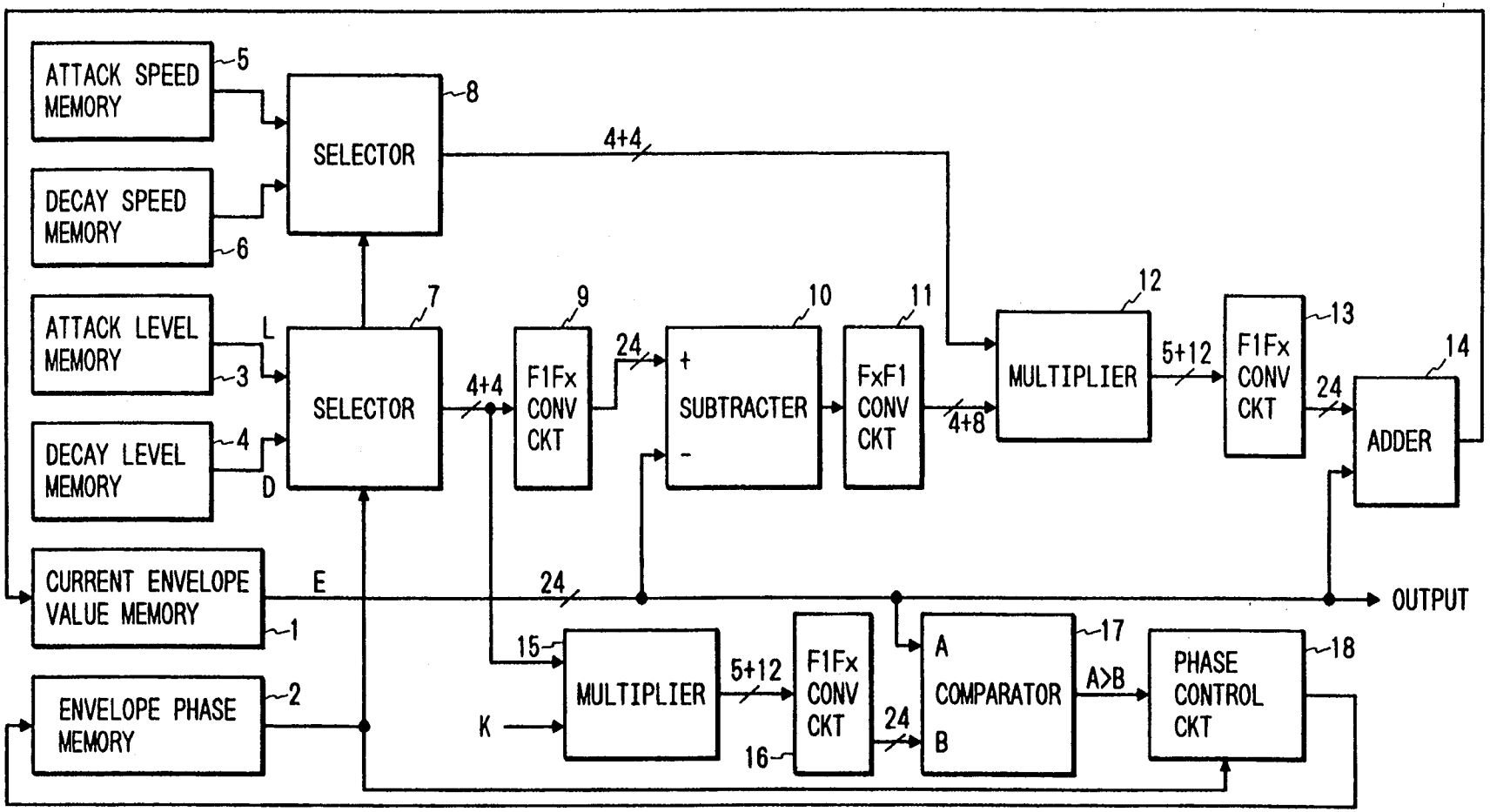
FIG. 3 PRIOR ART
FIG. 3 is a block diagram showing an example of the conventional envelope generator.

To judge whether or not this expression is valid, the logarithmic values of the attack level L, and of the difference (L−E) between the current value E and the attack level L are necessary. On the other hand, in the conventional envelope generator in FIG. 3, there are floating point data of the attack level L, and of the difference (L−E) between the current value E and the attack level L. Now, an examination is made of the error for the case that the floating point representation of a given numerical value x is used instead of the logarithmic value of it.

To represent the numerical value x in a floating point representation, x is expressed as in the following expression 2.

$$x=(i+M)\times 2^P\ (0\leqq M\leqq 1) \qquad \text{(Exp. 2)}$$

Here, the exponent part P is the integral part of $\log_2 x$, and the fractional part M is $[(x/2^P)-1]$. The floating point representation is to describe the numerical value x by these P and M. Then, a function F1(x) is defined as follows. This function F1(x) represents a numerical value having the exponent part of the floating point representation as the integral part and the fractional part as the decimal part.

$$Fi(x)=P+M=P+x/2P-1 \qquad \text{(Exp. 3)}$$

For instance, if x is described in a floating point representation with 8 bits comprising of 4 bits of the exponent part (higher order four bits) and 4 bits of the fractional part (lower order four bits), the value of the function F1(x) is obtained by deeming the 8-bit data as 8-bit data in a fixed point representation having a decimal point between the exponent part and the fractional part (between the lowest fourth and fifth bits).

On the other hand, the logarithms of both sides of the expression 2 to the base 2 give $$\log_2 x = P + \log_2(1+M). \quad \text{(Exp. 4)}$$

Figure 4:
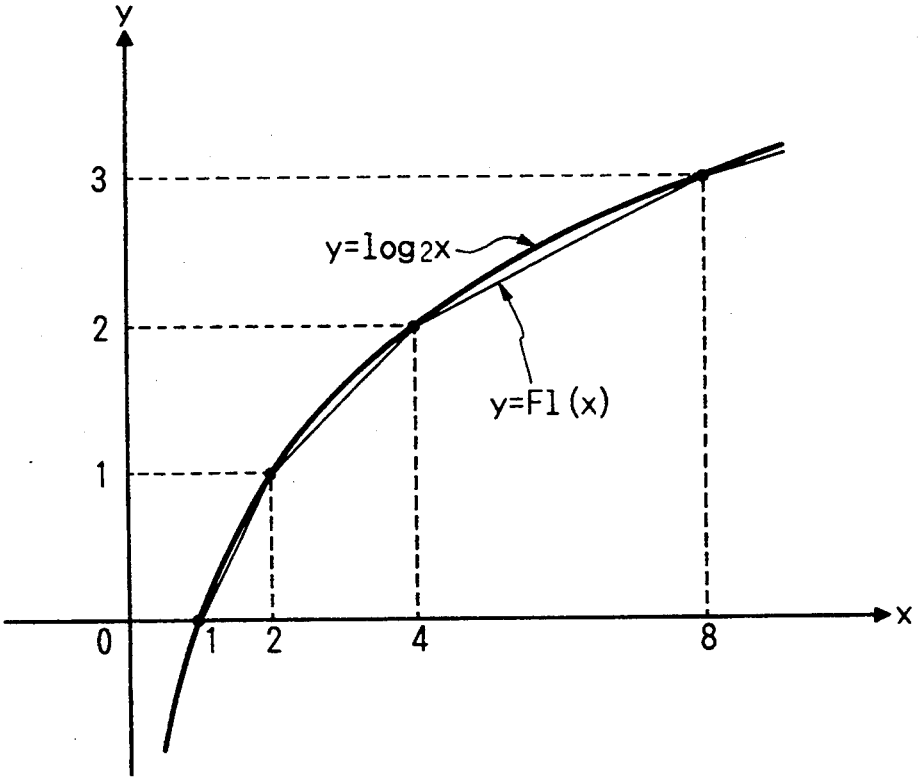
FIG. 4 is a graph showing a logarithmic function and a function when data in a floating point representation is deemed to be logarithm data.

FIG. 4 is a graph showing the logarithmic function $\log_2 x$ and the function F1(x). The function F1(x) is a broken line (polygonal) graph sequentially connecting the points where M is 0, or the respective points where $x=2^P$, and it is equal to the logarithmic function in the respective points. The error e between such two functions is as follows.

$$e = \text{Exp. } 4 - \text{Exp. } 3 = \log_2(1+M) - M$$

The ratio of the error e to x decreases as P increases, and becomes maximum at approximately the center in the possible range of M. For instance, $\log_2(6)$ is about 2.58, whereas F1(6) is 2.5, and the error e between them is merely in the order of 3%.

It is found from the foregoing that the following expression 5 can be used as a criterion expression for phase transfer instead of expression 1.

$$F1(L) - F1(L-E) > \log_2 10 \quad \text{(Exp. 5)}$$

Generally, if the approaching rate K at which the phase transfer should be performed is assumed to be $(0<K<1)$, $$F1(L) - F1(L-E) > \log_2 11/(1-K)]. \quad \text{(Exp. 5B)}$$

Figure 5:
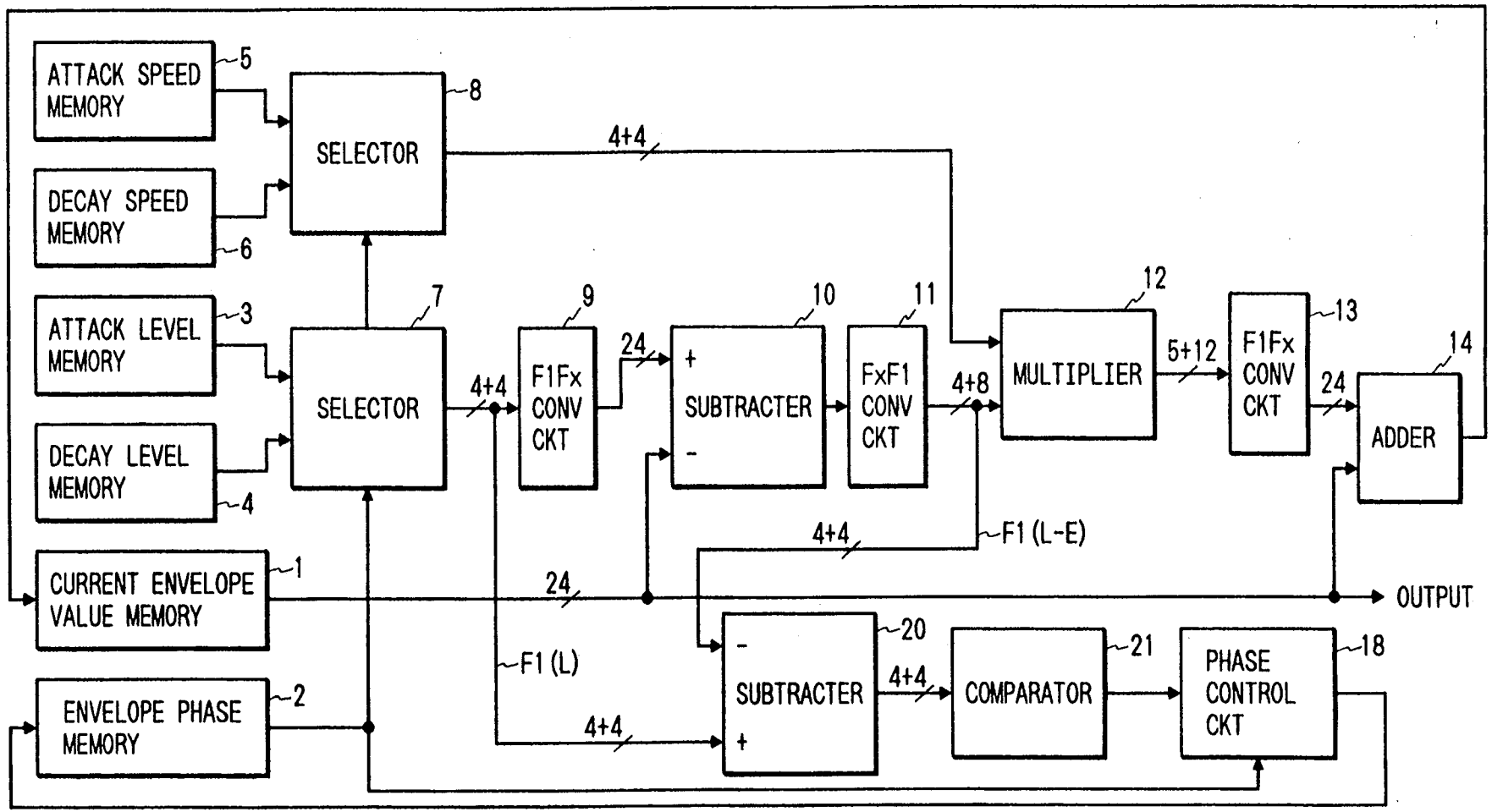
FIG. 5 is a block diagram showing an example of the envelope generator of the present invention.

Now, an embodiment of this invention will be described. FIG. 5 is a block diagram showing an example of the envelope generator of the present invention. The same numbers are assigned to those identical to FIG. 3.

Since the output of selector 7 is connected to the non-inverted input terminal of subtracter 20, (4+4)-bit floating point data showing the attack level is input in an attack phase. This data corresponds to Fi(L) in the expression 5. To the inverted terminal, the higher order eight bits of the output of FxF1 conversion circuit 11 are connected. This corresponds to Fi(L−E) of the expression 5.

Subtracter 20 makes subtraction with the two input data, simply deeming them as 8-bit fixed point data, to obtain the left side of expression 5. $\text{Log}_2 10$ of the right side of expression 5 is about 3.3. Accordingly, comparator 21 compares the output of subtracter 20 with a constant 3.3 which is the value of the right side of expression 5, and outputs 1 as a hitting signal if the output of subtracter 20 is greater than the other. This output is supplied to phase control circuit 18, where phase transfer control is performed as in the prior art example.

Figure 6:
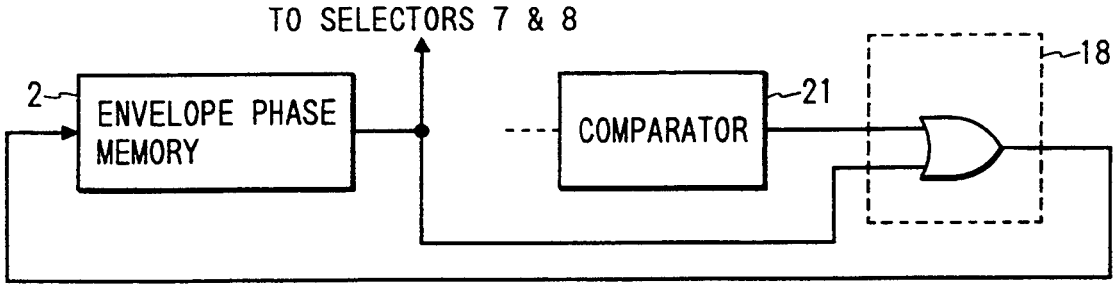
FIG. 6 is a circuit diagram showing an example of phase control circuit 18.

FIG. 6 is a circuit diagram showing an example of the configuration of phase control circuit 18. The phase control circuit can be comprised of an OR circuit as shown in the figure, and once "1" is output from comparator 21 as a hitting signal, the output of envelope phase memory 2 goes to 1 and this state is held till the next phase transfer.

As described above, only an 8-bit subtracter and an 8-bit comparator are needed to form an envelope phase transfer control circuit which is substantially similar to the conventional one in operation. It has been confirmed in a simulation using practical numerical data that the error of phase transfer timing t1 fell in the range of no practical problem.

The present invention can be modified as follows.

Figure 7:
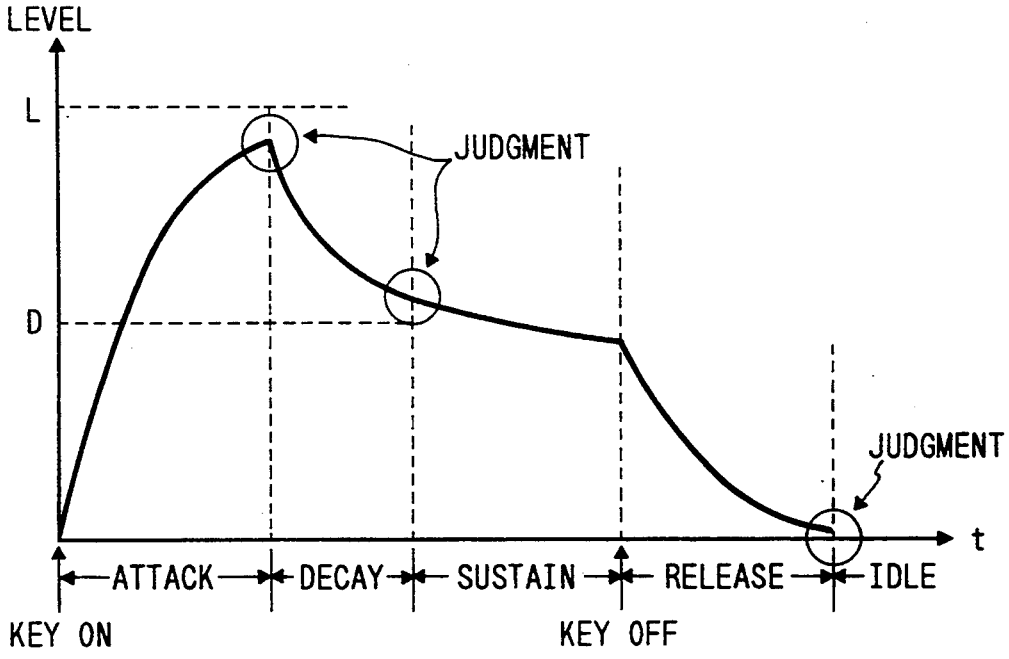
FIG. 7 is a wave diagram showing another example of the envelope wave.

Although only the transfer from attack phase to decay phase has been described above, the transfers from decay phase to sustain phase and/or from release phase to idle state are also controllable by a similar method, if consideration is given to the signs of target values in each phases. FIG. 7 is an example of the envelope having four phases. For generating such envelope, phase transfers of the portions marked by circles in the figure can be judged by the present invention. Since the target value is smaller than the current value in the judgment on transfer from decay phase to sustain phase and from release phase to idling, subtracter 10 subtracts the smaller value from the greater value to output the absolute value of the difference, and adder 14 adds the output of F1Fx converter 13 to the current value E after inverting the sign of the output to minus, that is, the output is subtracted from the current value E. In addition, it is possible to generate an envelope having any number of phases, and in this case, it is required to provide memories for storing as many data of speed, target level and phase as the number of phases.

Further, the subtracter 10 or adder 14 in FIG. 5 may be the one that calculates data in a floating point representation. In this case, F1Fx converters 9 and 13 and FxF1 converter 11 are unnecessary. However, since the current envelope value is also represented in a floating point mode, if an output in a fixed point representation is needed, a F1Fx converter is required before the output.

The constant in comparator 21 may be arbitrarily set. Although the embodiment exhibited an example in which the base of logarithms is 2, the present invention may be implemented by using logarithms to the base other than 2.

As apparent from the foregoing, in accordance with the present invention, there is an effect that the judgment on envelope phase transfer in an electronic musical instrument can be made with a smaller amount of hardware over the prior art.

What is claimed is:

1. An envelope generator in an electronic musical instrument wherein the envelope includes at least one phase; and wherein a current value approaching asymptotically as a function of time to a target level is generated in the at least one phase, said envelope generator comprising:

subtracter means for subtracting, from data representing said target value in a floating point representation, data representing the difference between said target level and said current value in a floating point representation, with deeming as real numbers having exponent parts of the floating point representation as integral parts and fractional parts thereof as the decimal part, and comparator means for comparing the output of said subtracter means with a predetermined constant, and if the output of said subtracter means is greater than the constant, generating a signal showing that an envelope phase transfer condition is met.

2. An envelope generator for an electronic musical instrument of claim 1 wherein said floating point data represents the exponent part by predetermined number of higher order bits and represents the fractional part by predetermined number of lower order bits.

3. An envelope generator for an electronic musical instrument of claim 1 wherein said comparator means detects at least one phase transfer of the phase transfers from attack to decay, from decay to sustain, and from release to idling.

4. An envelope generator for an electronic musical instrument of claim 1 wherein if a target approaching rate is K, said predetermined constant is $\}\log[1/(1-K)]\}$.

5. An envelope generator for an electronic musical instrument, the envelope generator comprising:

first memory means for storing and outputting a target value and speed data in floating point representations for each envelope phase, second memory means for storing and outputting an current envelope value, first subtracter means for subtracting the current envelope value from the target value, multiplier means for multiplying the output value of the first subtracter means by the speed data, adder means for adding the output value of the multiplier to the current envelope value to update the current envelope value, second subtracter means for subtracting, from the target level which was output from the first memory means, the output of the first subtracter means converted into a floating point representation, with deeming as fixed point data having decimal points between the exponent parts and the fractional parts, respectively, comparator means for outputting a hitting signal if the output value of the second subtracter means is greater than a predetermined constant, and envelope phase memory means for storing updated phase information therein if the hitting signal is output from the comparator means, and holding the phase information until the next phase transfer.

6. An envelope generator in an electronic musical instrument of claim 5 wherein the first memory means comprises:

means for storing the target level and speed data of each phase in floating point representations, and selector means for selecting to output the target level and speed data of each phase according to the current envelope phase.

7. An envelope generator in an electronic musical instrument of claim 5 wherein said first subtracter means comprises:

floating point data to fixed point data converter means for converting floating point data input thereto to fixed point data, means for subtracting the current envelope value from the target value converted into fixed point data, and fixed point data to floating point data converter means for converting the output of the subtracter means into a floating point data.

8. An envelope generator in an electronic musical instrument of claim 5 wherein the adder means comprising:

second floating point data to fixed point data converter means for converting the output of the multiplier into fixed point data, and means for adding the output value of a second floating point data to fixed point data converter means to the current envelope value to update the current envelope value, the second memory means storing the current envelope value in a fixed point representation.

* * * * *